United States Patent [19]

Conway et al.

[11] 4,101,619

[45] Jul. 18, 1978

[54] METHOD OF MAKING A DOLL HEAD

[75] Inventors: Lyle A. Conway; Rouben T. Terzian, both of Chicago; Donald K. Fletchic, Cicero, all of Ill.

[73] Assignee: Marvin Glass & Associates, Chicago, Ill.

[21] Appl. No.: 694,560

[22] Filed: Jun. 10, 1976

Related U.S. Application Data

[62] Division of Ser. No. 500,676, Aug. 26, 1974, Pat. No. 3,990,175.

[51] Int. Cl.[2] ..... B29C 5/04; B29C 5/12

[52] U.S. Cl. ..... 264/156; 264/310; 264/311; 425/425; 425/429; 425/435

[58] Field of Search ..... 264/310, 311, 154–156; 46/141, 115, 151, 135 A, 135 R; 425/425, 429, 430, 435

[56] References Cited

U.S. PATENT DOCUMENTS

| | | | |
|---|---|---|---|
| 1,506,062 | 8/1924 | Henker | 264/310 |
| 2,111,507 | 3/1938 | Hogan | 46/135 A |
| 2,830,325 | 4/1958 | Bray | 264/311 |
| 2,839,788 | 6/1958 | Dembiak | 264/310 |
| 2,923,032 | 2/1960 | Miller et al. | 264/154 |
| 2,944,814 | 7/1960 | Thoeming | 264/311 |
| 3,214,506 | 10/1965 | Corbin | 425/429 |
| 3,364,292 | 1/1968 | Lemelson | 264/310 |
| 3,364,292 | 1/1968 | Lemelson | 264/311 |
| 3,610,457 | 10/1971 | Opalewski | 220/22 |
| 3,694,957 | 10/1972 | Houghton | 46/135 R |
| 3,822,500 | 1/1974 | Ostrander | 46/141 |

*Primary Examiner*—Willard E. Hoag
*Attorney, Agent, or Firm*—Mason, Kolehmainen, Rathburn & Wyss

[57] ABSTRACT

Method for making a doll's head, for use in conjunction with a suitable torso, which will excrete a fluid through the brow portion of the head for simulating perspiration, and a method for making the same. The doll head includes an exterior surface formed and contoured with human characteristics and including an interior cavity or reservoir for storing fluid. The head is formed of flexible plastic having a slit at the mouth providing a valve for filling the interior reservoir and a plurality of small measured holes or pores in the brow or forehead which permit the fluid to flow outwardly therethrough. The method includes the steps of heating a mold containing heat curable plastic and slush molding the plastic to attain the interior shape of the mold. The mold comprises an outer head forming shell which is open at the neck for the insertion of plastic thereinto, and a cap which closes the neck and has a plug portion extending into the shell to form the interior reservoir of the head between the shell and the plug portion.

8 Claims, 7 Drawing Figures

METHOD OF MAKING A DOLL HEAD

This application is a division of application Ser. No. 500,676, filed Aug. 26, 1974 now U.S. Pat. No. 3,990,175.

BACKGROUND AND SUMMARY OF THE INVENTION

Dolls have been produced which can simulate some of the functions normally associated with an actual person. These types of dolls have been well received by the public and especially by children who derive much entertainment and pleasure from playing with a life-like toy. Particularly, dolls have been produced that can cry, eat, drink and perform other human functions associated with the head or face.

It is the object of this invention to provide a doll head which can perspire, as well as a simple molding method for producing the same.

The preferred embodiment of the doll includes a flexible head portion formed with an interior cavity or reservoir for storing a predetermined amount of fluid. The fluid is introduced into the reservoir through a one-way valve formed in the mouth portion of the head and seeps onto the forehead of the doll through a plurality of small orifices formed therein. Of course, the method could be used to form a tearing doll head as well.

DESCRIPTION OF THE PREFERRED EMBODIMENT

Figure 1:
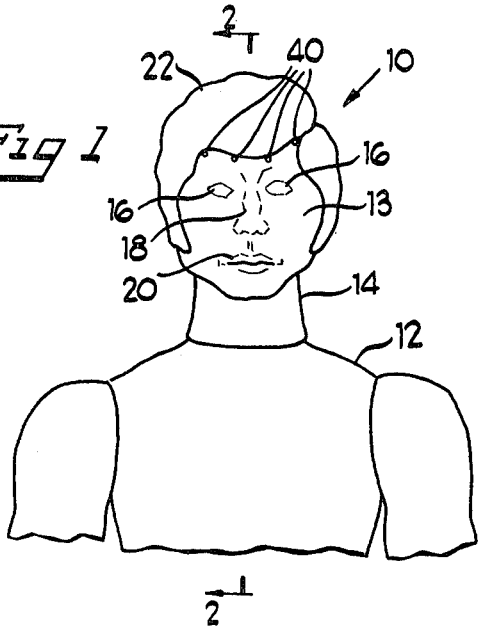
FIG. 1 is a front elevational view of the doll head of the present invention mounted on a suitable torso shown in phantom.
Figure 2:
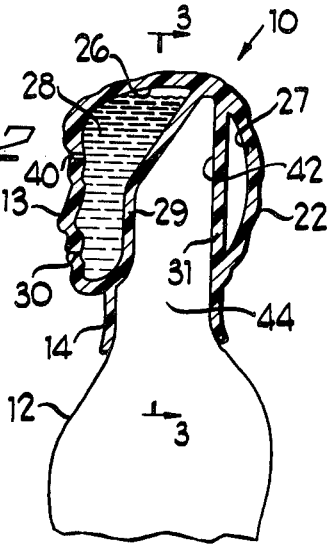
FIG. 2 is a vertical section taken generally along the line 2—2 of FIG. 1.

The doll or figure toy head, generally designated 10, of the present invention is seen mounted on a suitable torso 12 as shown in FIGS. 1 and 2. The head 10 is formed with a face 13 mounted on a neck portion 14. The face includes a pair of eyes 16, a nose 18, a mouth 20 and a simulated hair 22.

The head is manufactured with two (front and rear) closed interior cavities 26 and 27 (FIG. 2), respectively. The front cavity 26 is adjacent the face portion 13 of the head and extends upwardly behind the forehead. The front cavity 26 forms a fluid reservoir between the face 13 and an interior baffle 29 which is adapted to be filled with a fluid 28, such as water, through a flap valve or slit 30 provided in the mouth 20.

Figure 5:
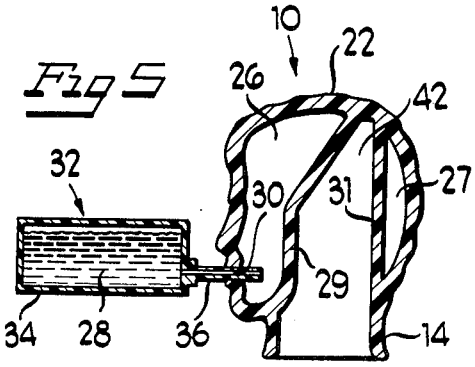
FIG. 5 is a vertical section, similar to FIG. 2, showing the reservoir filling device inserted through the mouth valve.
Figure 4:
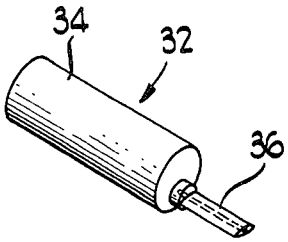
FIG. 4 is a perspective view of the reservoir fluid filling device of the present invention.

A reservoir filling device, generally designated 32 (FIG. 4), is provided which includes a tubular shaped, flexible cylindrical syringe portion 34 and a needle portion 36. The needle portion 36 can be inserted through the flap valve 30 in the mouth 20 as seen in FIG. 5 for filling the fluid cavity 26. The syringe portion 34 of the filler 32 is deformable so that the fluid 28 therein may be forced through the needle portion 36 into the cavity 26 within the head.

Referring again to FIG. 1, the head 10 includes a plurality of measured orifices 40 in the brow or forehead portion of the head which communicate with the interior cavity 26 and permit the fluid 28 therein to be forced outwardly therethrough onto the forehead of the doll when the head 10 is squeezed by the user, thereby simulating perspiration of a human being. It is preferable that the size of the orifices 40 be regulated during the manufacture or punching thereof so as to prevent unintended leaking of the fluid. The orifices 40 preferably are of a size small enough so that the surface tension of the water or other fluid across each orifice 40 will not allow water to inadvertently leak out of the cavity 26. However, the orifices should not be so small as to cause or permit capillary action along their length which could cause some of the fluid 28 to leak out.

An intermediate, internal recess 42 is formed in the head between the front cavity 26 and the rear cavity 27 during the formation of the internal walls 29 and 31 during the manufacture thereof as will be described in detail hereinafter. This internal recess 42 provides means for mounting the head of the figure toy or doll on a suitable torso 12 as shown in FIGS. 1 and 2. The torso portion 12 is formed with an upwardly extending stud or pin 44 (FIG. 2) for mounting the head. The upstanding pin 44 may be solid as shown, but it is not necessary that the pin 44 fill the entire recess 42. The pin 44 may extend into the neck portion 14 only so as to frictionally support the head 10 on the torso 12.

The chamber 26 is filled with the fluid 28, as shown in FIG. 2 through the mouth 20 by using the filling device 32. The fluid 28 can be caused to escape through the measured orifices 40 onto the forehead of the doll by applying pressure to the outside head portion about the chamber 26.

Although, as previously mentioned, the size of the orifices 40 prevent the fluid from inadvertently seeping onto the forehead, some modifications of the procedure during use are possible to effect different results without departing from the spirit of the invention. For example, the cavity 26 can be filled with a cold fluid by chilling the reservoir filler 32 prior to use. After inserting the low temperature fluid into the cavity 26, natural expansion of the liquid 28 at a room temperature will cause some of the fluid to be forced through the measured orifices 40 thereby simulating a perspiring doll.

The construction illustrated is merely exemplary and not intended to be limited to the several figures shown in the drawings. For example, the measured orifices 40 in the forehead could be provided elsewhere on the doll's face in communication with the fluid cavity. Additional orifices could be provided on the cheeks and/or chin of the doll head 10 to provide additional pores for the fluid to escape onto the face of the doll 10 simulating perspiration.

Figure 6:
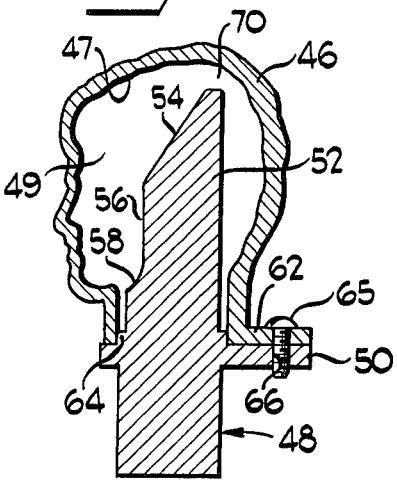
FIG. 6 is a front to rear central section through the mold employed in the method of the present invention.
Figure 7:
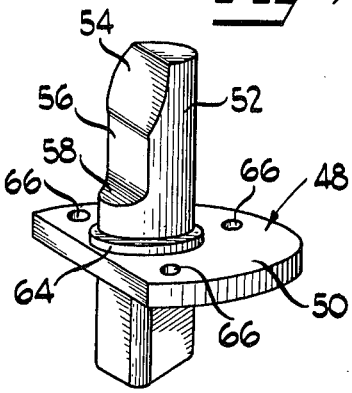
FIG. 7 is a perspective view of the base or cap and plug component of the mold of FIG. 6.

A new method is provided for making the doll head of the present invention. The method includes the use of a shell-type head mold 46 as seen in FIG. 6. The interior surface 47 of the head mold 46 will define the exterior surfaces of the finished product. Therefore, the interior surface 47 should be provided with the necessary shape to form the eyes 16, nose 13, mouth 20 and the simulated hair 22 of the finished doll head 10. A cap or base mold portion, generally designated 48, as shown in perspective in FIG. 7, is used in conjunction with the head mold 46 to provide a closed cavity 49 as seen in FIG. 6.

The base mold portion 48 includes a generally circular flange 50 formed around an upstanding stud or plug portion 52. The plug portion 52 will form the closed cavities 26 and 27 as well as the open recess 42 during the molding process in a single operation and yet provide all of the above described structure in a unitary head rather than a head of multiple parts. The stud 52 is generally cylindrical in shape having a plurality of flat surfaces 54, 56 and 58 on the front side thereof. The flat surfaces 54 through 58 will form the baffle or wall 29 which is the rear wall of the cavity 26 and also the front wall of the recess 42. The back surface area of the cylindrical stud 52 will form a second wall or baffle 59 which is the back wall of the recess 42 and the front wall of the cavity 27. The head mold 46 also includes a generally circular flange 62 which engages a circular shoulder 64 provided on the flange 50 of the base portion 48 and is secured to the flange 50 by a plurality of screws 65 which engage threaded holes 66 therein. The circular shoulder 64 is provided to facilitate proper alignment of the head mold 46 with the base mold portion 48 during assembly.

Figure 3:
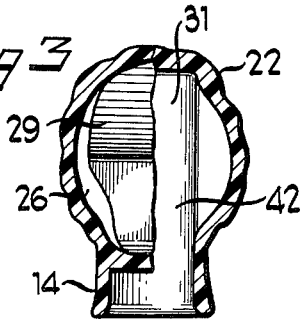
FIG. 3 is a fragmented vertical section taken generally along the line 3—3 of FIG. 2 with a portion of the rear wall of the front cavity removed.

In the method of the present invention, a measured amount of heat curable vinyl plastic is introduced into the internal cavity of the head mold shell 46. The base mold portion 48 is thereafter assembled to form the total mold and fastened by the screws 65. The mold then is heated and rotated or "tumbled" to cause the plastic to "slush" within the assembled mold and cover all of the interior surfaces thereof. The heat causes the plastic to set and maintain the shape of the mold as shown in FIGS. 1 through 3. During this slush molding process the space 70 (FIG. 6) between the interior surface 47 of the head mold portion 46 and the stud 52 about the top and sides thereof will be fully covered by the viscous liquid plastic and thereby form the forward closed chamber 26 and the rearward closed chamber 27 in the head. It is also possible to manufacture the head 10 wherein the chambers 26 and 27 are contiguous. This result is achieved by using a lesser amount of heat curable plastic than was previously described. In this instance, the space between the vertical sides of the plug portion 52 and the shell mold 46 will not be completely closed and therefore the rear chamber 27 will be in communication with the forward chamber 26 thereby providing a larger internal fluid cavity which will be capable of holding more fluid 28.

After the plastic has set, the head 10 can be removed from the shell 46 by removing the cap 48. The orifices 40 then can be punched in the forehead. This punching operation must remove a small section or plug to prevent the orifices 40 from closing after the punching tool is removed. The flap valve 30 is provided by cutting a slit in the mouth without removing any material since this opening must remain closed during use. Both the punching and slitting operation can be performed simultaneously.

This molding method therefore allows an interior, closed chamber to be formed within the head 10 such that the head may be removed from the torso 12 and replaced without a loss of fluid from the interior fluid chamber 26.

The foregoing detailed description has been given for clearness of understanding only and no unnecessary limitations should be understood therefrom as some modifications will be obvious to those skilled in the art.

We claim:

1. A method of making a doll head for the excretion of liquid from the interior of the head, comprising the following steps:
   - providing a hollow mold shell defining the exterior contours of the doll head;
   - introducing an amount of heat curable plastic through an opening in said hollow mold shell;
   - closing said mold shell by means of a mold cap over said opening, said mold cap including an elongated plug portion extending across the interior of said mold shell to form an interior mold partition;
   - rotating and heating the assembled mold shell and mold cap to cause the plastic to blanket the interior surfaces of the mold shell and plug portion and to cure the plastic onto said surfaces to maintain the shape of the mold and forming two closed cavities between the mold shell and plug portion; and
   - forming apertures in the head to provide fluid communication between said reservoir and the exterior of the head.

2. The method of claim 1 wherein said rotating and heating steps are performed substantially simultaneously.

3. The method of claim 1 wherein said elongated plug portion of said mold cap is inserted into close proximity to the interior surfaces of said mold shell about two opposite sides of the plug portion and the top thereof so as to form a partition between two separate cavities within the head as the plastic cures and closes gaps between the interior of the mold shell in said sides and top of the plug portion.

4. The method of claim 1 wherein said aperture forming step includes the formation of apertures in the forehead of the doll in communication with said reservoir for the passage of liquid therethrough from the reservoir.

5. The method of claim 4 including the step of forming a slit generally in the mouth area of the doll head to form a flap valve for the introduction of liquid therethrough into said reservoir.

6. A rotational mold for manufacturing a doll's head having a self-contained interior closed cavity, comprising:
   - a hollow mold shell defining exterior contours of the doll's head, said shell having an opening for the introduction of a moldable plastic; and
   - a mold shell cap for closing said opening, said cap including a projecting plug portion extending into the interior of said mold for forming an interior wall within and completely across the molded head and forming two closed cavities therein.

7. In a method for making a perspiring doll having a unitary head, said head including a flexible plastic shell, a unitarily molded, interior wall spanning a portion of said shell and forming a liquid reservoir generally behind the face of the doll head, a plurality of apertures through said flexible shell generally in the facial area of the doll head for the passage therethrough of liquid from said reservoir to simulate perspiration, and means for filling said reservoir; the following method steps:
   - providing a hollow mold shell defining the exterior contours of said doll head;
   - providing a closing mold cap for said mold shell including a projecting plug portion to be inserted into the mold shell in sufficiently close proximity to the walls of the mold shell to have curable plastic form walls between said walls and said projecting portion;

introducing an amount of heat curable plastic into said hollow mold shell;

closing said mold shell by inserting said plug portion of said mold cap into the cavity of said shell mold to form a mold assembly;

rotating and heating the mold assembly to cause the plastic to blanket the interior surfaces thereof including said plug portion and to cure the plastic onto said surfaces to maintain the shape of the mold and forming a partition across said cavity to define a self-contained liquid reservoir between the mold shell and said plug portion of the mold cap; and forming apertures in the head to provide fluid communication between said reservoir and the exterior of the head.

8. In a method for making a doll head including a flexible plastic shell, a unitarily molded interior wall spanning a portion of said shell and forming a reservoir generally behind the face of the doll head for holding liquid, a plurality of apertures through said flexible shell generally in the facial area of the doll head for the passage therethrough of liquid from said reservoir and inlet means for said reservoir for the purpose of introducing liquid into said reservoir; the following method steps;

providing a hollow mold shell having an inner surface defining the exterior contours of said doll head;

providing a closing mold cap for said mold shell including a plug portion for insertion into the mold shell;

introducing an amount of curable plastic into said hollow mold shell;

closing said mold shell by inserting said plug portion of said mold cap into the cavity of said shell mold to form a mold assembly;

rotating the mold assembly to cause the plastic to blanket the inner surface including said plug portion and curing the plastic onto said surface to maintain the shape of the mold and forming two closed cavities therein between the mold shell and said plug portion of the mold cap; and forming apertures in the head to provide fluid communication between said reservoir and the exterior of the head.

* * * * *